US007021684B2

(12) United States Patent
Orbeta et al.

(10) Patent No.: US 7,021,684 B2
(45) Date of Patent: Apr. 4, 2006

(54) SURFACE MOUNTED ELECTRIC STRIKE

(75) Inventors: Ferdinand E. Orbeta, Mount Kisco, NY (US); William Schildwachter, Brewster, NY (US)

(73) Assignee: Trine Access Technology, Inc., Bronx, NY (US)

( * ) Notice: Subject to any disclaimer, the term of this patent is extended or adjusted under 35 U.S.C. 154(b) by 141 days.

(21) Appl. No.: 10/861,700

(22) Filed: Jun. 4, 2004

(65) Prior Publication Data

US 2005/0280267 A1 Dec. 22, 2005

(51) Int. Cl.
*E05B 15/02* (2006.01)

(52) U.S. Cl. ..... 292/341.16; 292/201

(58) Field of Classification Search ..... 292/341.15, 292/341.16, 201, 340
See application file for complete search history.

(56) References Cited

U.S. PATENT DOCUMENTS

| | | | | |
|---|---|---|---|---|
| 3,211,860 | A | 10/1965 | Toepfer | |
| 3,640,560 | A | 2/1972 | Zawadzki et al. | |
| 4,626,010 | A | 12/1986 | Hanchett et al. | 292/341.16 |
| 4,836,707 | A * | 6/1989 | Myers | 403/322.4 |
| 4,986,584 | A | 1/1991 | Logas | |
| 5,172,945 | A * | 12/1992 | Doherty et al. | 292/49 |
| 5,484,180 | A | 1/1996 | Helmar | 292/341.16 |
| 5,915,766 | A * | 6/1999 | Baumeister et al. | 292/341.15 |
| 6,390,520 | B1 | 5/2002 | Holzer | |
| 6,595,563 | B1 | 7/2003 | Kiernan | 262/341.16 |
| 6,857,671 | B1 * | 2/2005 | Fly | 292/251.5 |

FOREIGN PATENT DOCUMENTS

EP 05 25 3421 9/2005

OTHER PUBLICATIONS

O'Leary, T: "Why Electric Strikes?", Locksmith Ledger International, Locksmith Pub. Corp., Park Bridge, IL, US, vol. 63, No. 1, Jan. 2003, pp. 3-40, 42, XP-001141526, ISSN: 1050-2254.

* cited by examiner

*Primary Examiner*—Gary Estremsky
(74) *Attorney, Agent, or Firm*—Norris, McLaughlin & Marcus

(57) ABSTRACT

A surface mounted electric strike which can be installed on a door jamb without cutting the door jamb. The strike employs a simplified locking mechanism whereby two latches are releasably engaged by a single yoke. An electrical solenoid actuates a cam which directly actuates the yoke. The strike can operate in a fail safe mode or a fail secure mode.

11 Claims, 13 Drawing Sheets

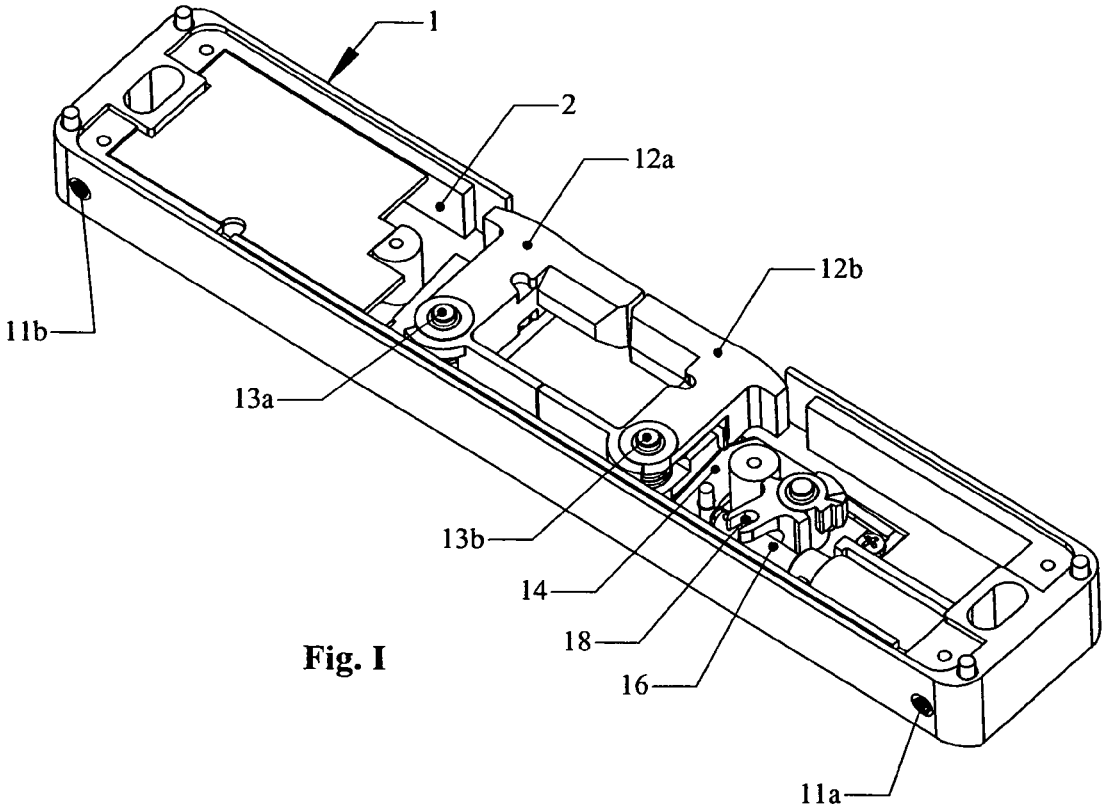
Fig. I

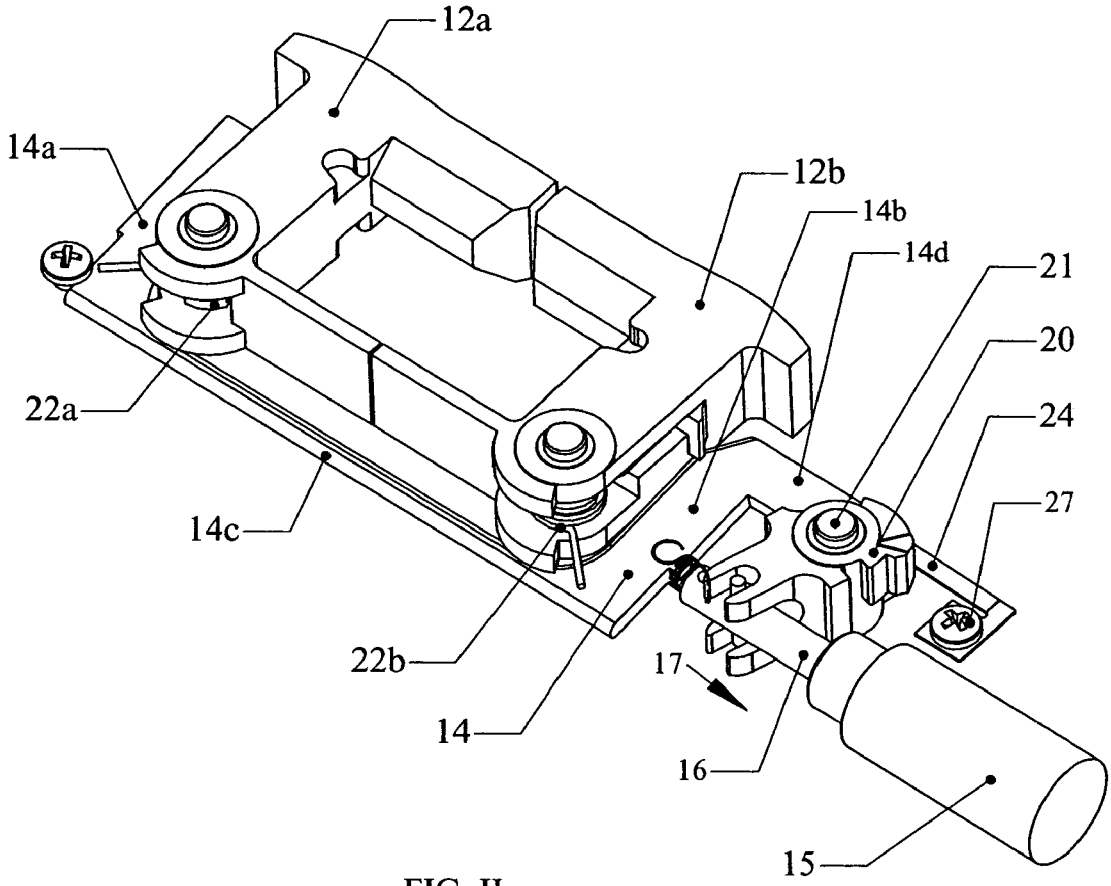
FIG. II

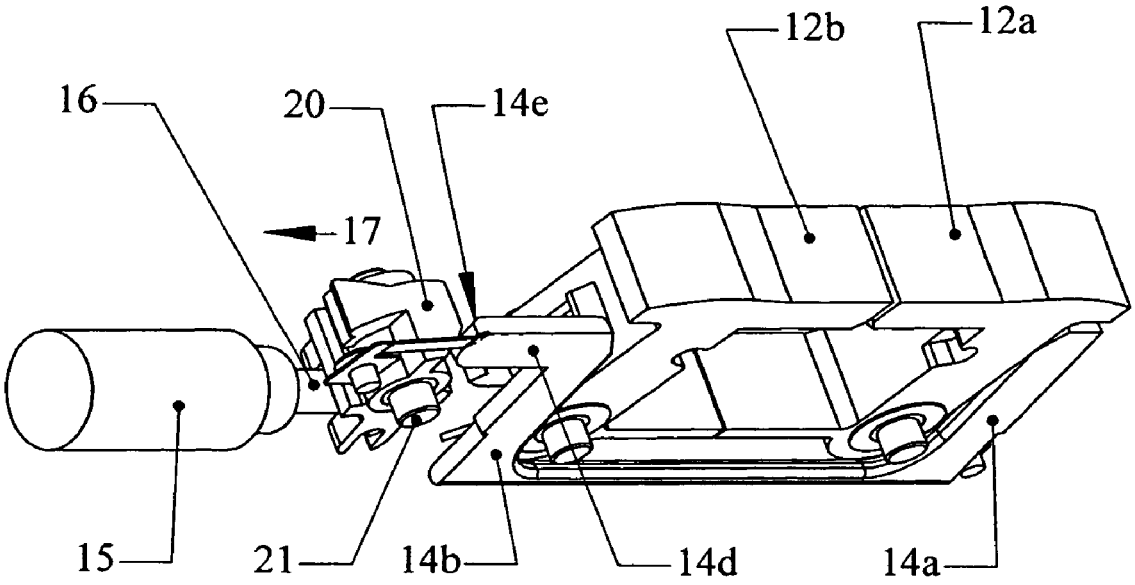
FIG. III

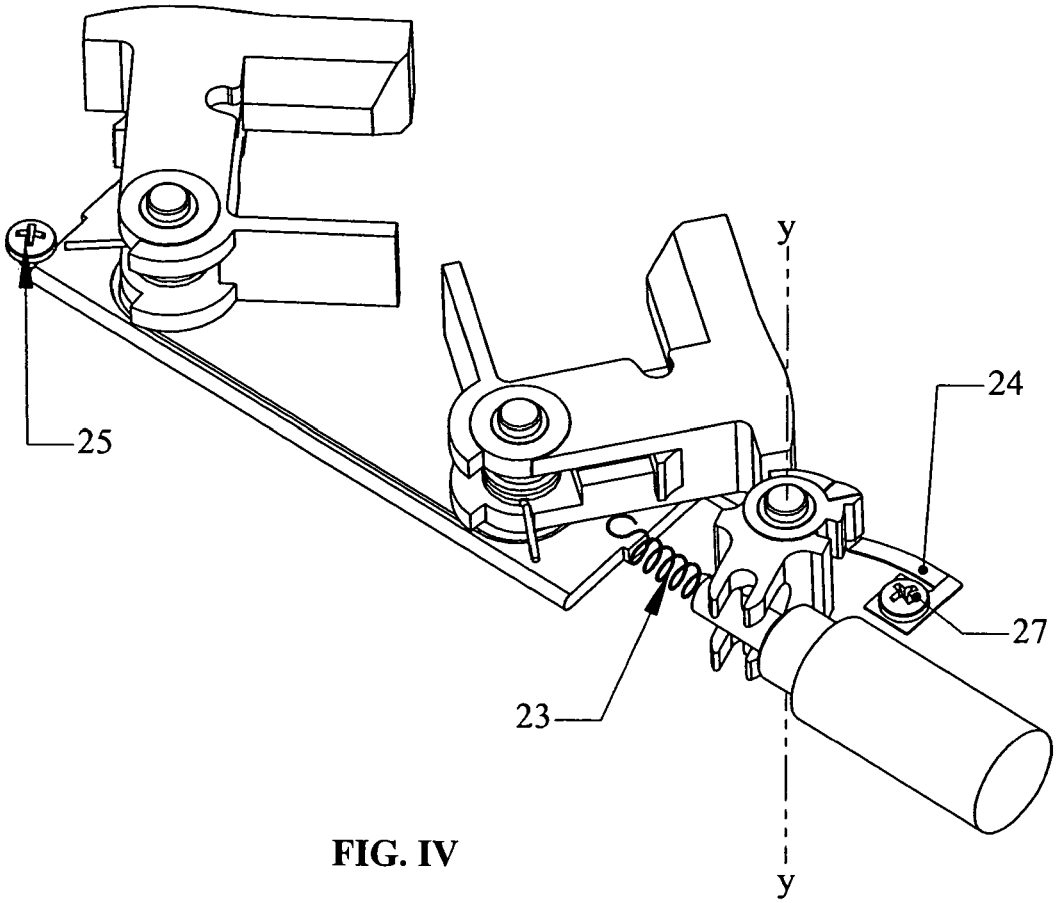
FIG. IV

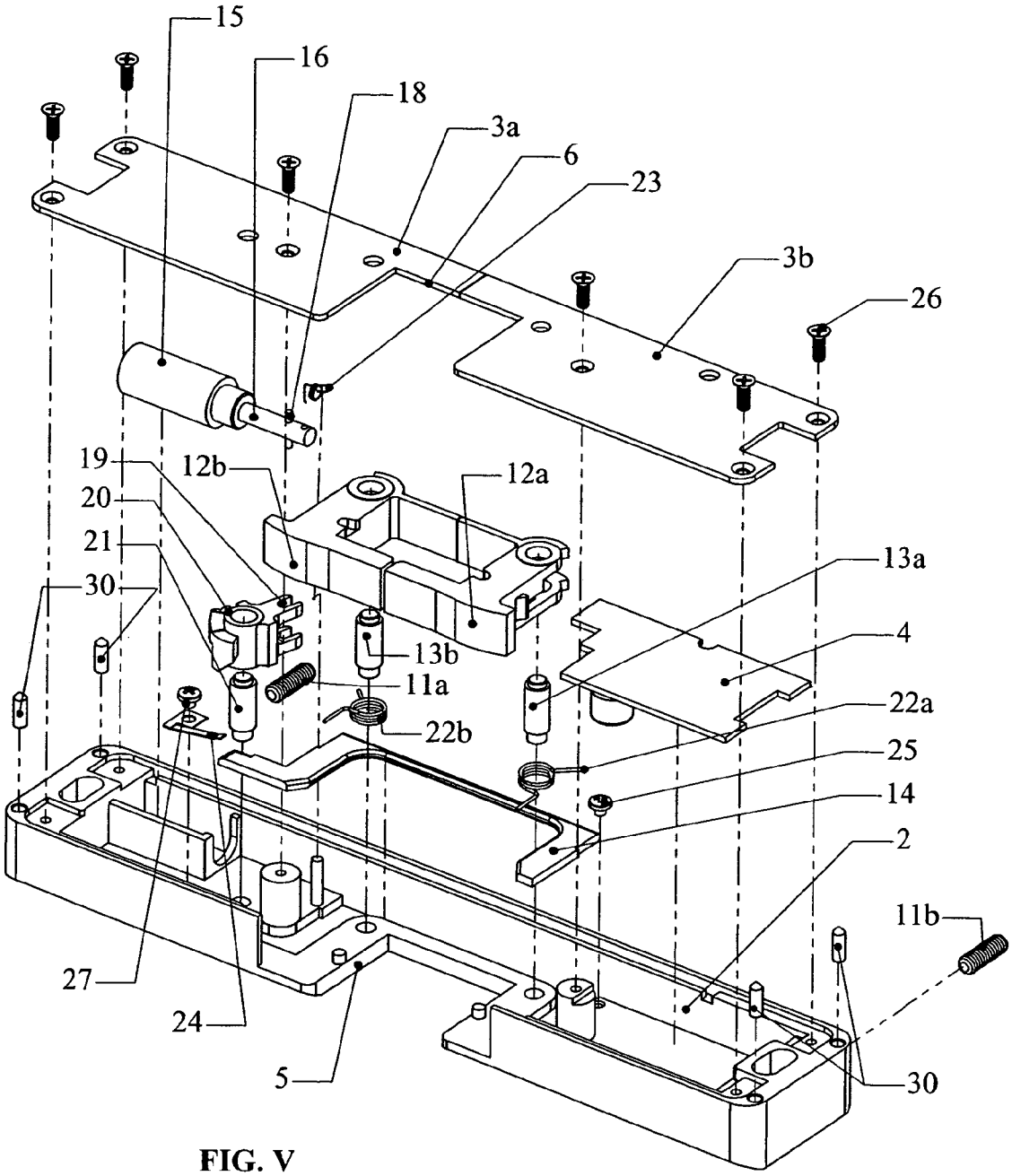
FIG. V

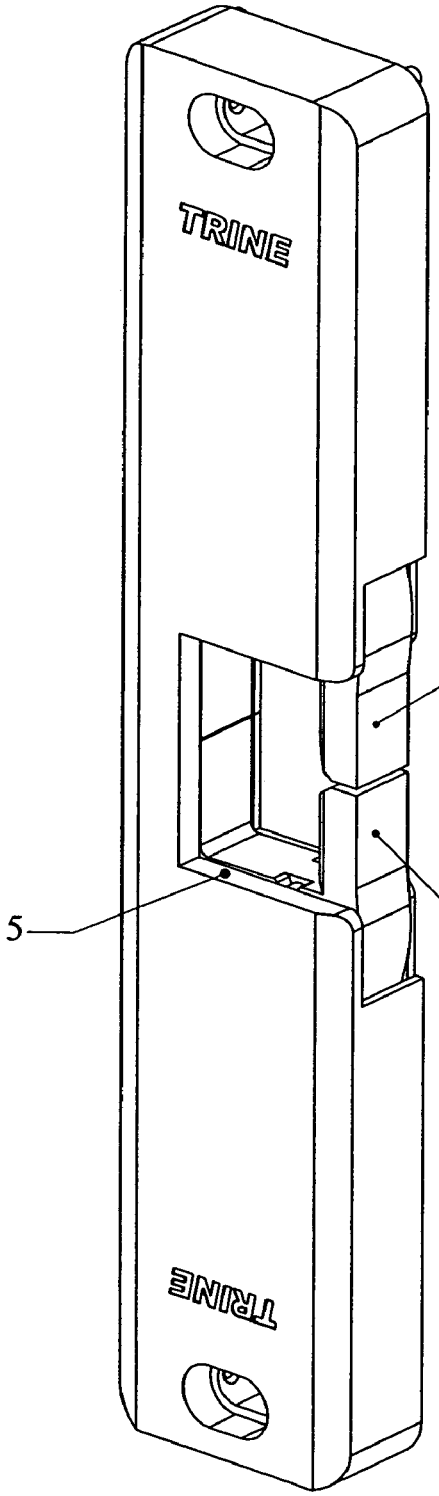
FIG. VI
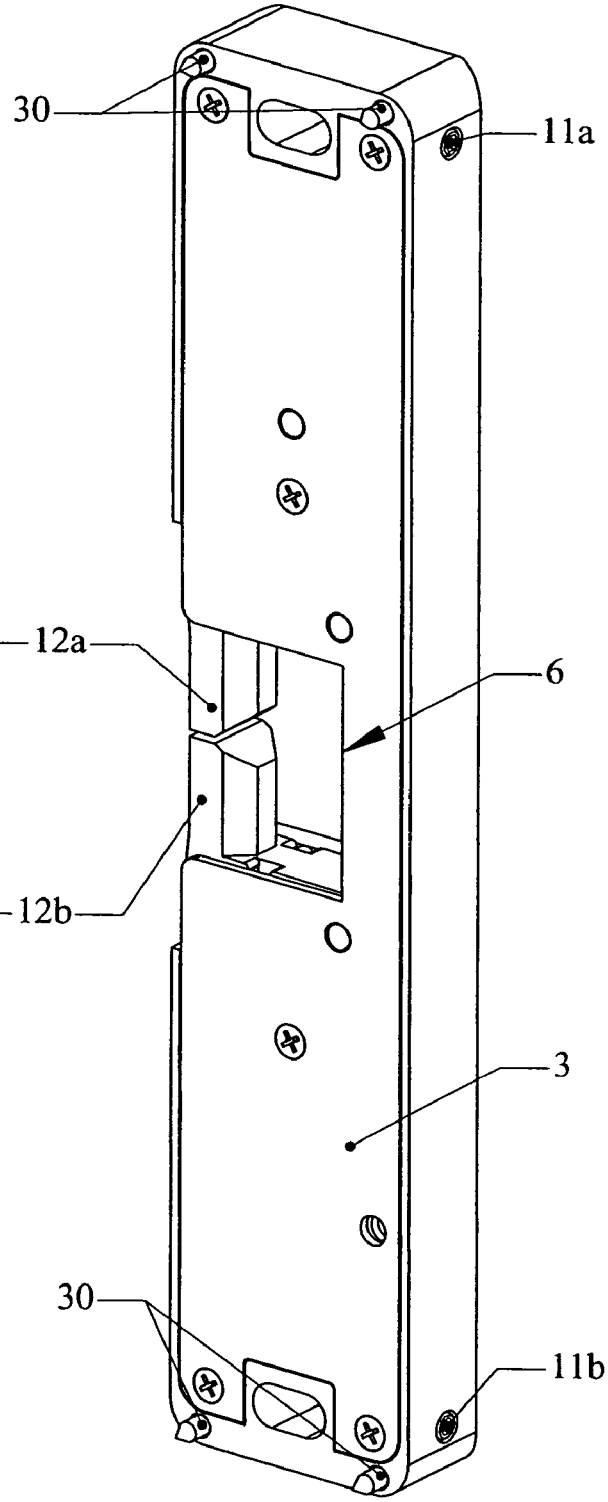
FIG. VII

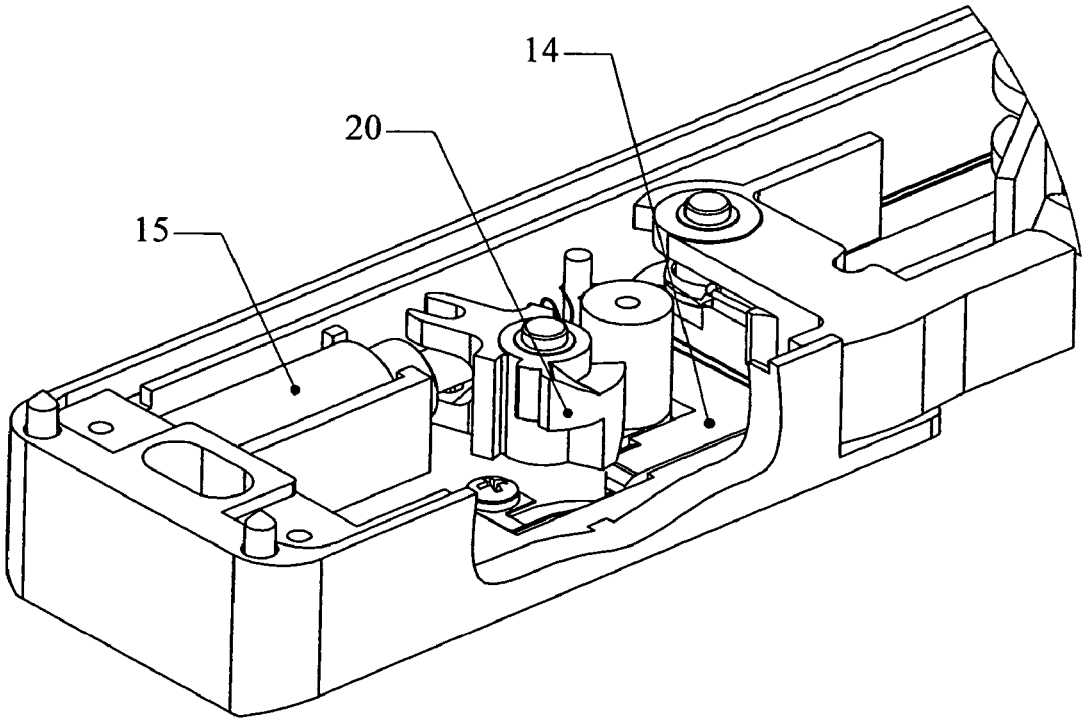
FIG. VIIIa

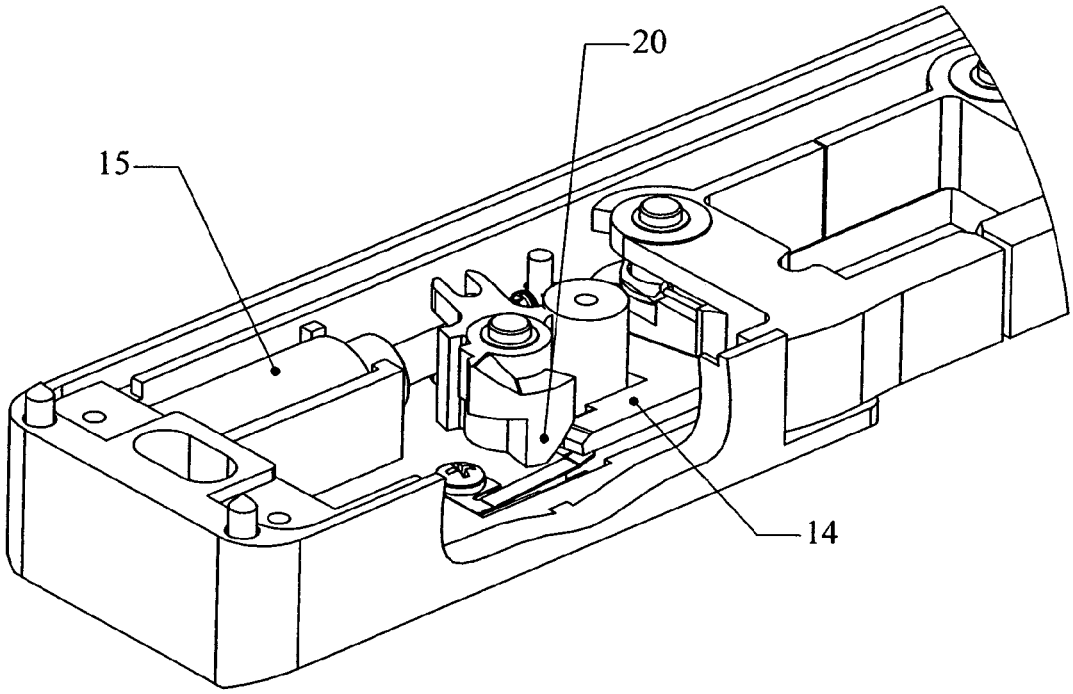
FIG. VIIIb

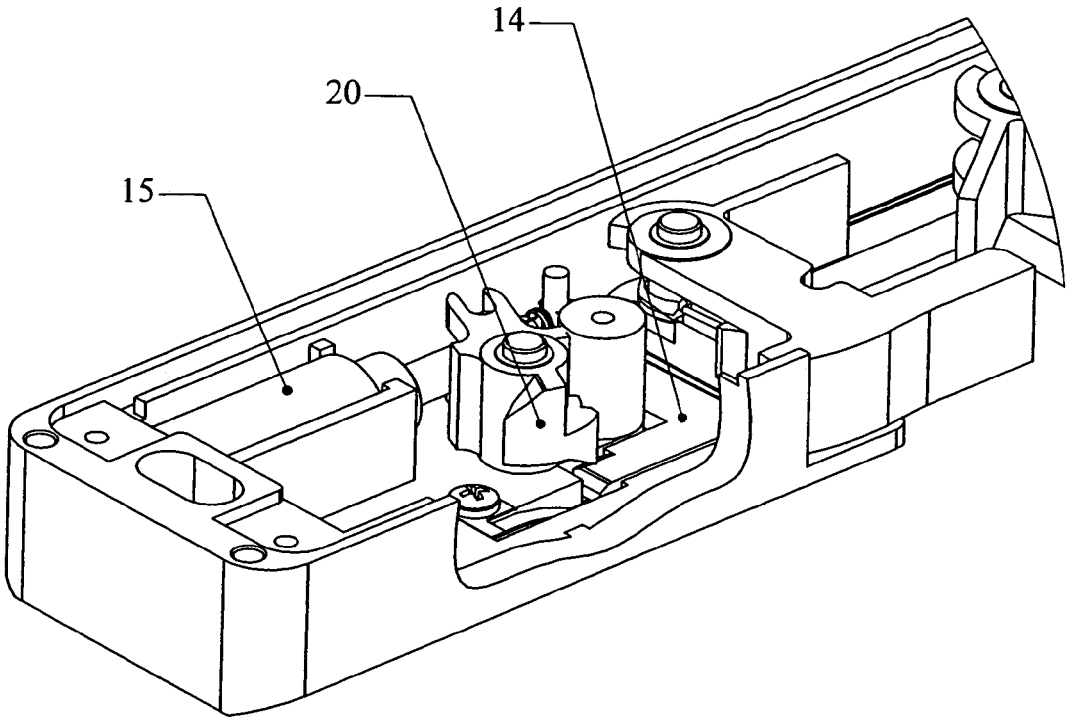
FIG. IXa

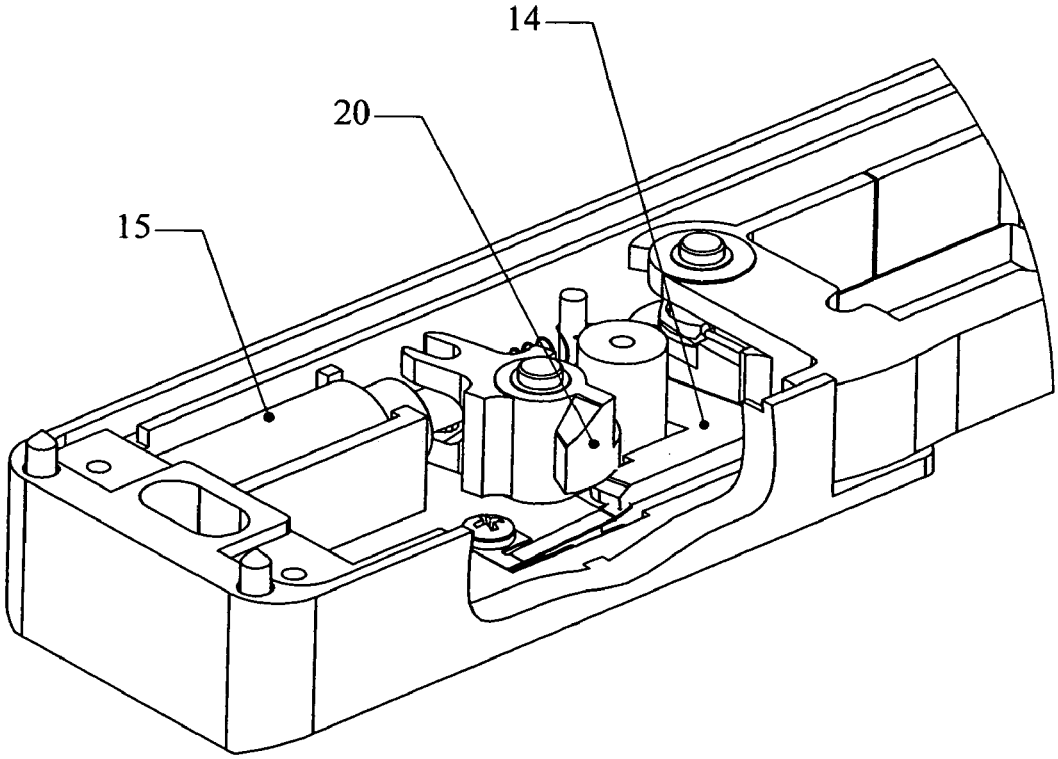
FIG. IXb

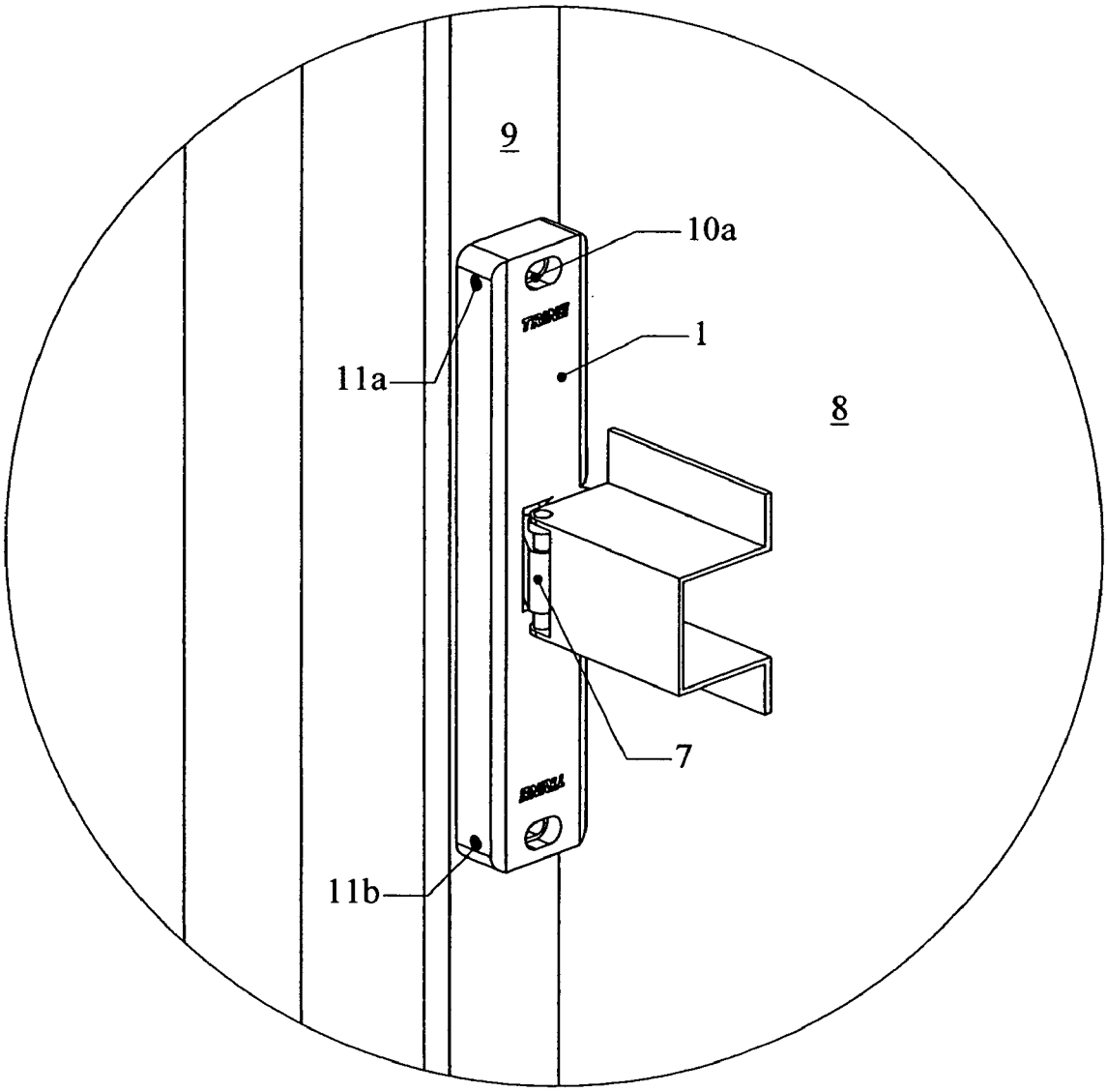
FIG. X

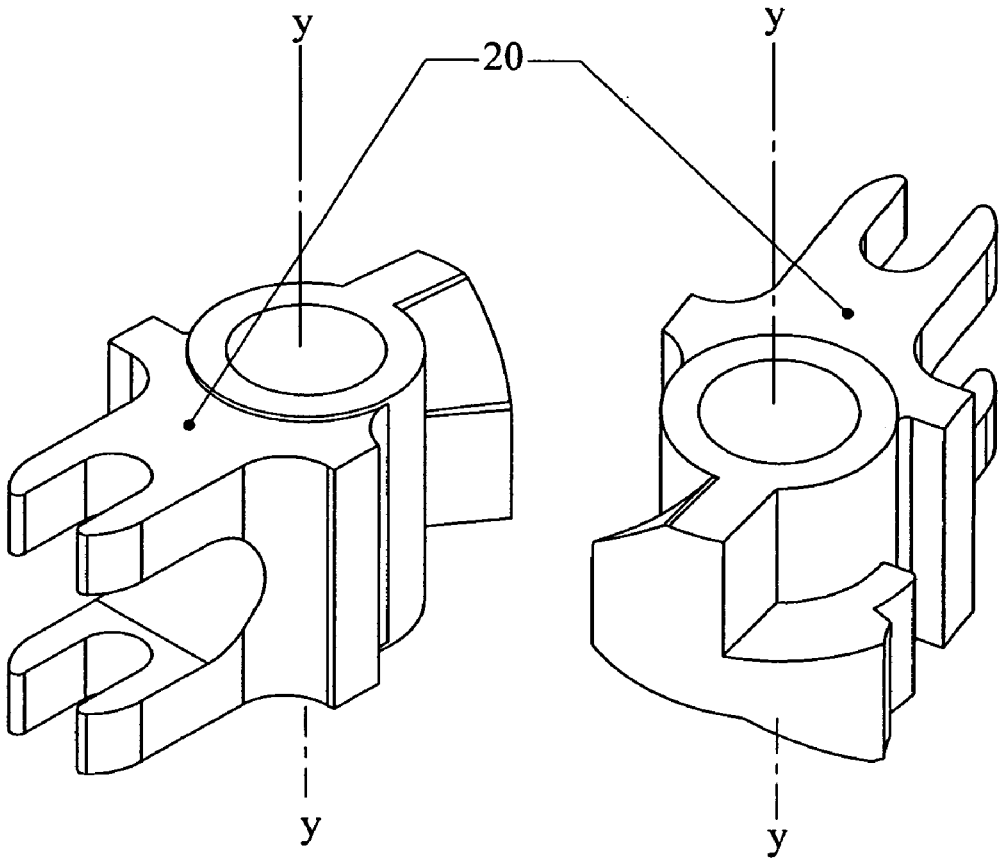
FIG. XIa FIG. XIb

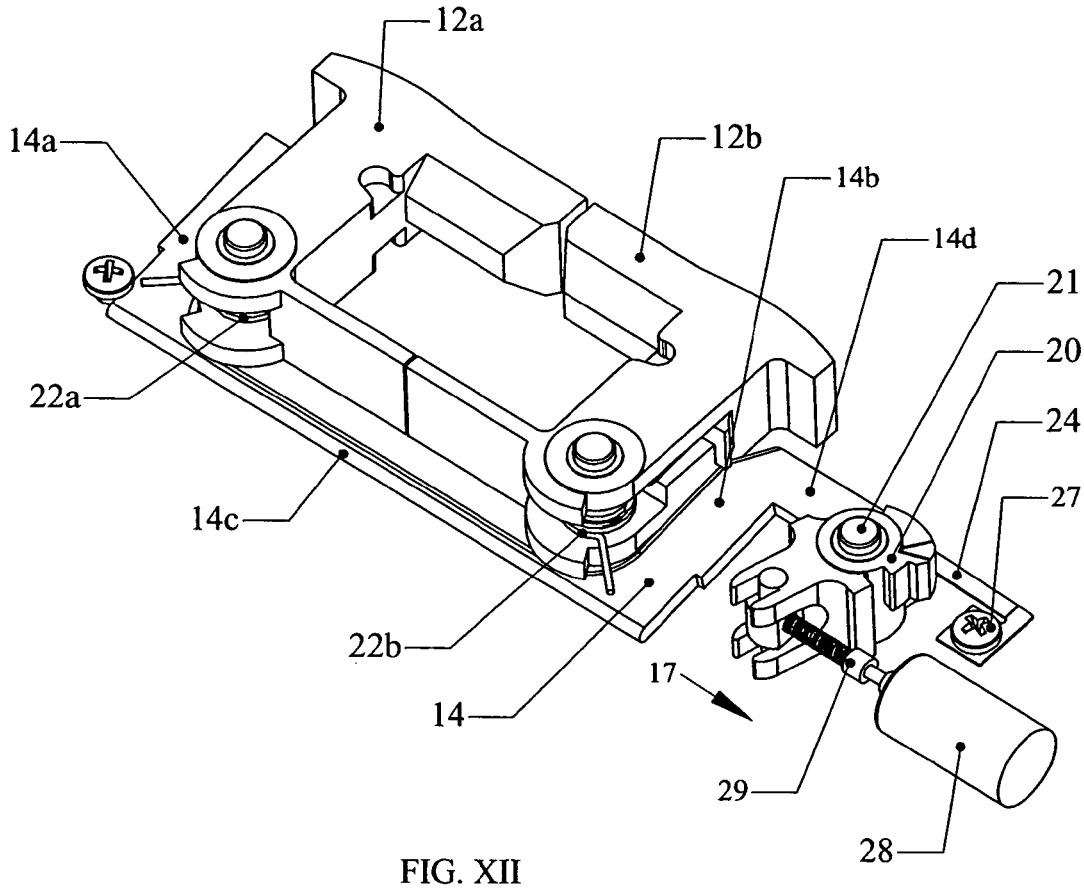
FIG. XII

SURFACE MOUNTED ELECTRIC STRIKE

BACKGROUND OF THE INVENTION

1. Field of the Invention

The present invention has to do with electric strikes which can be used to electrically release or lock a door lock. In particular, the invention has to do with a surface mounted electric strike which can be installed on a doorjamb without cutting the doorjamb.

2. The Related Art

Surface mounted electric strikes that can be installed on a door jamb without cutting the door jamb provide a flexible and cost effective solution to the need for an electric strike. One such strike is described in U.S. Pat. No. 6,390,520 which discloses an electric door opener which can be used in either a fail safe or fail secure mode.

It is an object of the present invention to provide a surface mounted electric strike having a simplified operating mechanism and a strengthened locking mechanism.

SUMMARY OF THE INVENTION

The electric strike of the present invention employs a locking mechanism whereby two latches are pivotally mounted to a housing and releasably engaged by a single yoke. The yoke is pivotally mounted to the housing and is directly actuated by a cam. The cam is actuated electrically such as by a solenoid, a miniature motor and screw drive or the like.

The cam can be designed to cause operation of the strike in a fail secure mode or a fail safe mode depending upon which side of the cam faces the yoke. To switch from one mode to another, the cam is simply removed, turned upside down and reinstalled. In the fail secure mode, the yoke is in the locking position unless it is moved to the unlocking position by the cam. In the unlocking position the latches are free to move and they will open when pressure is applied to them by the bolt of a door as the door is opened. When the cam is returned to its locking position, a spring urges the yoke back to its locking position when the latches have returned to their locked positions. Each latch is provided with a spring which urges the latches to return to their locked positions when they pivot out of their locked positions as the bolt is pulled out of the strike.

In fail safe operation, the cam is installed to maintain the yoke in its unlocking position. When the electrical solenoid is actuated, the cam is moved to its locking position and the yoke spring causes the yoke to move to its locking position, thereby maintaining the latches in their locking positions.

BRIEF DESCRIPTION OF THE DRAWINGS

FIG. I is a perspective view of the present invention with the back cover removed.

FIG. II is perspective top view of the active components of the present invention in a locked position.

FIG. III is a perspective bottom view of the active components of the invention in a locked position.

FIG. IV is a perspective top view of the active components of the invention in an unlocked position.

FIG. V is an expanded perspective view of the product of the invention.

FIG. VI is a front perspective view of the product of the invention.

FIG. VII is a back perspective view of the product of the invention.

FIGS. VIII A and B illustrate an embodiment of the invention which operates in a fail secure mode.

FIGS. IX A and B illustrate an embodiment of the invention which operates in a fail safe mode.

FIG. X illustrates the product of the invention mounted on a door jamb.

FIG. XI A illustrates the cam 20 of the invention in perspective and FIG. XI B illustrates the cam of FIG. XI A rotated about axis y—y.

FIG. XII illustrates a motor and screw drive, as an alternative electrical actuator, connected to the cam 20.

DESCRIPTION OF THE PREFERRED EMBODIMENT

Referring to FIGS. I–V and X, surface mounted electric strike 1 comprises a housing 2, and a cover 3 which support and protect the active components. The cover 3 can be in more than one piece such as 3*a* and 3*b* as illustrated in FIG. V. Cutout portions 5 and 6 in the housing 2 and cover 3, respectively, are adapted to receive the bolt 7 of a door 8. The cover 3 is held in place by screws 26. The strike 1 is mounted on door jamb 9 using installation screws 10*a* and 10*b* which optionally are held in place by set screws 11*a* and 11*b*. The set screws prevent the installation screws from loosening as a result of the pounding caused by the opening and closing of the door. As a further option or another option, pins 30 can be employed to stabilize the installation and also prevent the early loosening of the installation screws.

Latches 12*a* and 12*b* are mounted on pivots 13*a* and 13*b* and the latches are held in the locked position by yoke 14. The yoke 14 is comprised of legs 14*a* and 14*b*, edge 14*c* and arm 14*d* having tapered edge 14*e*. The latches are unlocked when solenoid 15 is actuated by electrical current in the conventional manner known in the art. When the solenoid 15 is activated, shaft 16 moves in the direction of arrow 17 and the pin 18 mounted in shaft 16 causes the arm 19 of cam 20 to move in the direction of arrow 17 thereby rotating cam 20 about pin 21. This causes cam 20 to push against tapered edge 14*e* and cause yoke 14 to pivot on edge 14*c* thereby moving legs 14*a* and 14*b* downwardly to disengage latches 12*a* and 12*b*. The latches 12*a* and 12*b* then are free to move to open positions when one pulls on the door 8 causing the bolt 7 to be pulled out of the strike 1. Latch springs 22*a* and 22*b* cause latches 12*a* and 12*b* to return to their closed positions after the bolt 7 is pulled out of the strike 1. The bolt 7 retracts into the door 8 as the bolt 7 passes the latches 12*a* and 12*b* when the door closes.

Electrical devices other than a solenoid can be used to lock or unlock the latches. For example, an electric motor 28 and screw drive 29 can be used as illustrated in FIG. XII.

FIGS. I–III illustrate the active components in their locked positions and FIG. IV illustrates the active components in their unlocked positions. When the electrical current to the solenoid 15 is turned off, shaft 16 is returned to its original position by spring 23 as best illustrated in FIG. IV. The yoke 14 then is returned to its locked position by lock spring 24 provided that the latches 12*a* and 12*b* have returned to their locked positions. Lock spring 24 is held in place by screw 27. The yoke 14 can be pivotally mounted to housing 2 by suitable means such as screw 25. Screw 25 is installed with sufficient clearance relative to yoke 14 to permit the yoke to freely move from a locked to an unlocked position and back while preventing the yoke from moving out of its operating position. Housing 2, in cooperation with set screw 25, also serves to maintain the yoke in its operating position.

An expanded view of the components of the invention is provided in FIG. V.

FIGS. I–IV illustrate the strike 1 of the invention configured to operate in a fail secure mode where the door 8 is locked unless the solenoid 15 is actuated. However, the strike 1 can easily be made to work in a fail safe mode (where the door 8 is unlocked unless the solenoid 15 is actuated) by simply removing cam 20 from a first installation position, turning it upside down and reinstalling it in a second installation position. FIGS. VIII A and B, IX A and B and XI A and B illustrate the cam 20 in more detail with FIG. VIII A showing the cam 20 installed in the fail secure operating mode with solenoid 15 energized showing the yoke 14 in its unlocked position and FIG. VIII B showing the same components with solenoid 15 de-energized showing yoke 14 in its locked position. FIG. IX A illustrates the cam 20 installed in the failsafe operating mode with solenoid 15 de-energized and the yoke in its unlocked position and FIG. IX B shows the same components with solenoid 15 energized showing the yoke in its locked position. FIG. XI A illustrates the cam 20 by itself in perspective and FIG. XI B illustrates the cam 20 of FIG. XI A after it has been rotated approximately 180° about axis y—y.

What is claimed is:

1. An electric strike comprising:

a housing, two latches pivotally mounted to the housing and having parallel axes of rotation, yoke means pivotally mounted to the housing and releasably engaged with the latches and having an axis of rotation perpendicular to the axes of rotation of the latches, the yoke means having a locking position wherein it is engaged with the latches and maintains the latches in a locked position, and having an unlocking position wherein it is disengaged from the latches, thereby permitting the latches to rotate on their axes in an unlocked condition, latch spring means engaging each of the latches and urging the latches to move to the locked position, cam means pivotally mounted to the housing in actuating engagement with the yoke means, the cam means having a locking position and an unlocking position, yoke spring means engaging the yoke means and urging the yoke means to move to the locking position, electrical means engaging the cam means for moving the cam means from the locking position to the unlocking position when the electrical means is actuated or for moving the cam means from the unlocking position to the locking position when the electrical means is actuated, wherein moving the cam means from the locking position to the unlocking position causes the yoke means to move from the locking position to the unlocking position thereby unlocking the latches, and moving the cam means from the unlocking position to the locking position causes the yoke spring means to move the yoke means from the unlocking position to the locking position thereby locking the latches.

2. The electric strike of claim 1 wherein the electrical means comprises a solenoid.

3. The electric strike of claim 1 wherein the electrical means comprises an electric motor and screw drive.

4. The electric strike of claim 1 wherein the cam means is configured to cause the strike to operate in a fail secure mode when it is installed in a first installation position or to cause the strike to operate in a failsafe mode when it is installed in a second installation position.

5. The electric strike of claim 4 wherein the cam means in the second installation position is upside down as compared with the cam means in the first installation position.

6. The electric strike of claim 4 wherein the cam means is installed on a pin means.

7. The electric strike of claim 5 wherein the cam means is installed on a pin means.

8. The electric strike of claim 1 wherein the electric strike is installed on a doorjamb using two installation screws.

9. The electric strike of claim 8 wherein set screws are employed to stabilize the installation screws.

10. The electric strike of claim 8 wherein pins are provided in the housing and extend therefrom into the door jamb to stabilize the installation screws.

11. The electric strike of claim 9 wherein pins are provided in the housing and extend therefrom into the door jamb to stabilize the installation screws.

* * * * *